United States Patent [19]

Watling

[11] Patent Number: 4,613,013

[45] Date of Patent: Sep. 23, 1986

[54] SUSPENSION LADDER

[76] Inventor: Nigel C. Watling, Picketts Hill House, Picketts Hill, Headley, Nr. Bordon, Hampshire, England

[21] Appl. No.: 773,214

[22] Filed: Sep. 6, 1985

[30] Foreign Application Priority Data

Sep. 13, 1984 [GB] United Kingdom ..... 8423102

[51] Int. Cl.[4] ..... E06C 1/383; E06C 1/52; E06C 7/08

[52] U.S. Cl. ..... 182/20; 182/164; 182/196; 182/206

[58] Field of Search ..... 182/163, 164, 40, 41, 182/73, 74, 196, 197, 198, 46, 20, 206

[56] References Cited

U.S. PATENT DOCUMENTS

| | | | |
|---|---|---|---|
| 277,222 | 5/1883 | Bush | 182/196 |
| 288,455 | 11/1883 | Landes | 182/196 |
| 2,998,863 | 9/1961 | Larson | 182/164 |
| 3,139,949 | 7/1964 | Graves | 182/164 |
| 3,295,269 | 1/1967 | Schuster | 182/41 |
| 3,397,546 | 8/1968 | Eisert | 182/164 |
| 3,744,591 | 7/1973 | Lucci | 182/46 |
| 4,023,647 | 5/1977 | Confer | 182/46 |

*Primary Examiner*—Reinaldo P. Machado
*Attorney, Agent, or Firm*—Larson and Taylor

[57] ABSTRACT

A suspension ladder comprises a string of identical rigid rectangular sections (1) which are hinged together about a series of parallel axes adjacent their longer rear edges (2), and each of which has one or more apertures (11) forming a rung of the ladder. Each section (1) has a trapezoidal cross sectional profile providing the section with sloping top and bottom edge faces (4) and (5) which converge towards the front face (6) from the longitudinal rear edges (2) and form stops which limit the extent to which adjoining sections can pivot towards each other in a forward direction. The ladder therefore cannot be flexed in this direction beyond a predetermined minimum radius of curvature and will therefore form a substantially rigid cradle (21) when its lower end is lifted while its upper end is suspended. In contrast adjacent sections can pivot flat against each other in the rearward direction so that the ladder can be rolled up tightly for easy storage.

11 Claims, 5 Drawing Figures

SUSPENSION LADDER

This invention relates to a suspension ladder, i.e. a ladder which is intended to be used suspended from its upper end, and aims to provide such a ladder which is particularly suitable for use, amongst other things, as a safety ladder for boats, especially sailing boats and yachts.

One of the greatest dangers for sailors at sea is that of falling or being washed overboard, and this is particularly so in cold waters since a person's survival time reduces with water temperature and in some cases may only be a matter of minutes, even in British coastal waters. Consequently it is essential not only to get alongside a person in the water as quickly as possible, but also to get him or her back on board quickly. However, this last task often proves extremely difficult, particularly when the person to be rescued is either unconscious or exhausted and is therefore a dead weight and unable to help in any way, and indeed many deaths have occurred as a result of failure at this stage of a rescue. Furthermore, it is now considered that the way in which a person is lifted back on board is also important, since it has been determined that great stress is placed on the heart and body during a lift with the body substantially vertical, which could explain why deaths sometimes occur even after a rescue. What is required therefore, is a convenient device which can be used on a boat to lift a person from the water and back on board in a relatively quick, easy and safe manner, and it is for this purpose that the ladder in accordance with the present invention has been designed, although it should be appreciated that the ladder can be used for other purposes.

According to the invention, a suspension ladder comprises a string of substantially rigid sections which form the rungs of the ladder and which are hinged together about a series of parallel axes so that the ladder is flexible in the plane perpendicular to the axes, and stops for limiting the extent to which adjoining sections can pivot towards each other on one side of the ladder so that the ladder cannot be flexed on this side beyond a predetermined minimum radius of curvature.

As will be appreciated, this minimum radius of curvature to which the ladder can be bent on the one side is determined by the angle between adjoining sections at which the stops prevent further pivoting of the sections towards each other and also the distance between the hinge axes of the sections. If the ladder is to be used as a marine rescue ladder, these parameters are preferably chosen to produce a minimum radius of curvature between 0.25 and 0.40 meters, preferably about 0.34 meters, so that the ladder will bend to form a cradle suitable for supporting comfortably, but safely, the torso of a fully clothed person lying face down across the ladder. For example, a hinge spacing of about 0.12 meters and stops which prevent adjoining sections from pivoting towards each other to produce an included angle less than 160° will prevent the ladder from bending to a curvature tighter than the preferred minimum radius of about 0.34 meters.

When required for use in a marine rescue, the ladder is suspended over the side of the boat with its limited flexibility side facing outboard and with its lower end well below the surface of the water but connected to a hoisting line such as a halyard. Usually the ladder will be suspended from the edge of the deck by means of at least one hook which is fixed or connected to the upper section and which hooks over the toe-rail, but if this is not possible the ladder may be suspended by means of a rope or cable which can be fastened to the upper section of the ladder after passing it around the mast or any other suitable fixture on the deck. If the person in the water is still strong enough, he or she can simply use the ladder in the normal way to climb back on board, the ladder being much easier to use than a conventional rope ladder since the individual sections are rigid and there is substantially no lateral flexibility in the direction parallel to the hinge axes. However, as is more likely, if the person in the water is incapable of doing this, the lower end of the ladder is raised so that the ladder bends to form a cradle just below the surface of the water, and the person either manoeuvres himself, or is manoeuvred by a rescuer who has climbed down the ladder, over the cradle until lying face downwards with his or her torso supported substantially horizontally by the cradle. The lower end of the ladder is then slowly raised to lift the person in this position (which is much less stressful than with the body suspended vertically) and finally to deposit the person back on deck.

As will be appreciated, as the lower end of the ladder is raised the portion of the ladder forming the cradle, which of course adopts the predetermined minimum radius of curvature, gradually changes, moving towards the opposite end of the ladder. The weight of the person being rescued will naturally tend to keep the person in the bottom of the cradle, but one of the rescuers will usually make sure that the person remains safely supported as the ladder is raised and therefore moves beneath the person, the rescuer holding onto and climbing down the outside of the ladder as the lower end is raised.

It will thus be understood that the ladder in accordance with the invention can provide a safe and efficient way of getting an exhausted person out of the water and back on board, and without requiring any modification of the boat or any equipment, apart from the ladder itself, which will not otherwise be present on the boat. In fact, many boats do actually carry a ladder, usually a rope ladder, and the ladder in accordance with the invention may simply take its place.

To facilitate storage of the ladder when not required it is preferable that it should be possible to roll the ladder up as small as possible, and for this purpose the sections of the ladder are preferably hinged together so that adjoining sections are capable of pivoting to a position in which they lie substantially flat against each other, i.e. through substantially 180° relative to each other, on the opposite side of the ladder from that on which the stops are operative. One form of hinge which would permit such movement of adjoining sections comprises a pair of interconnected parallel hinge pins, one of which is received rotatably in a socket in one of the sections, and the other of which is received rotatably in a socket in the other section.

The hinges may be permanently fastened in position, but if preferred they may be arranged to be removable so that sections may be added to or removed from the ladder in order to extend or reduce its length as desired.

Preferably the stops comprise surfaces on each pair of adjoining sections which are arranged to engage each other to prevent further pivoting of the sections towards each other after the sections have pivoted towards each other on the one side of the ladder to reach a predetermined included angle. As mentioned earlier, this angle will be determined by the dimensions and purpose of the ladder, but will usually be between 150° and 170°.

Preferably the sections are identical to each other, except perhaps for the end sections which may be provided one with means for suspending the ladder and the other with means for the attachment of a hoist, and each section therefore has a portion forming a rung of the ladder.

Particular examples of the ladder in accordance with the invention will now be described with reference to the accompanying drawings, in which.

Figure 1:
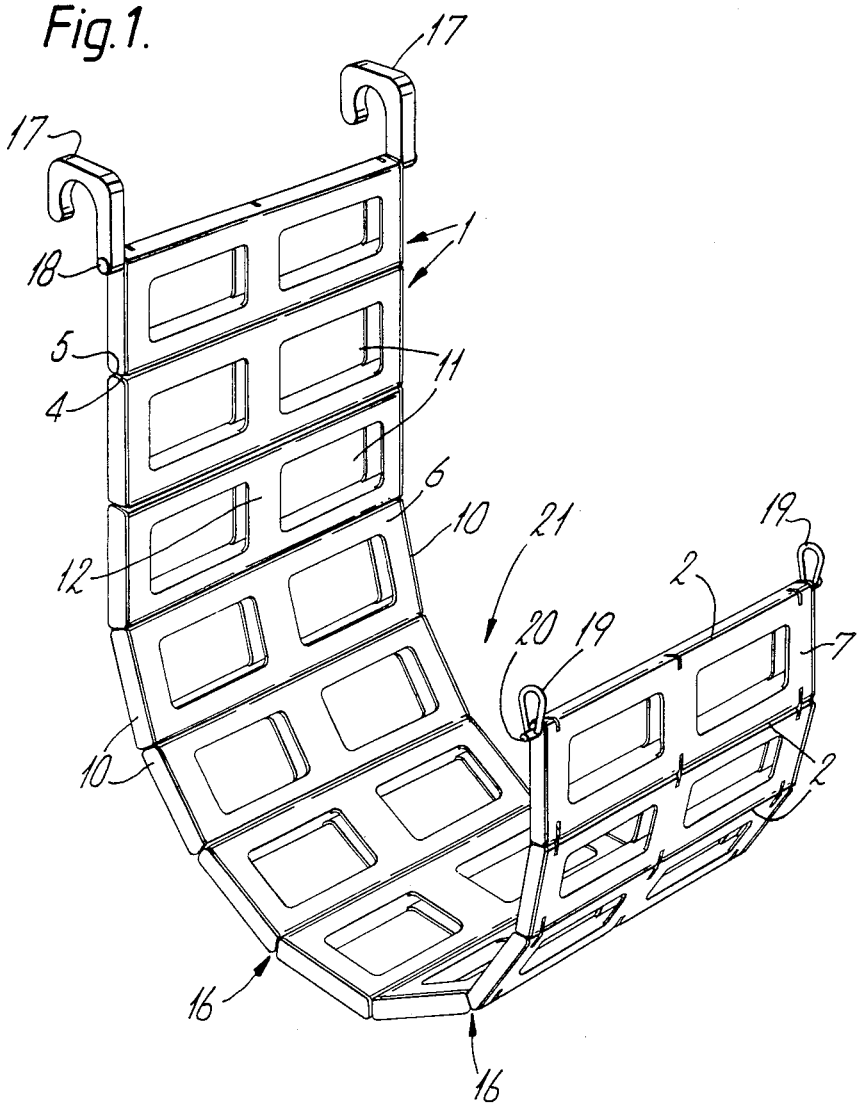
FIG. 1 is a front perspective view of one example illustrating the ladder in a cradle forming configuration.
Figure 2:
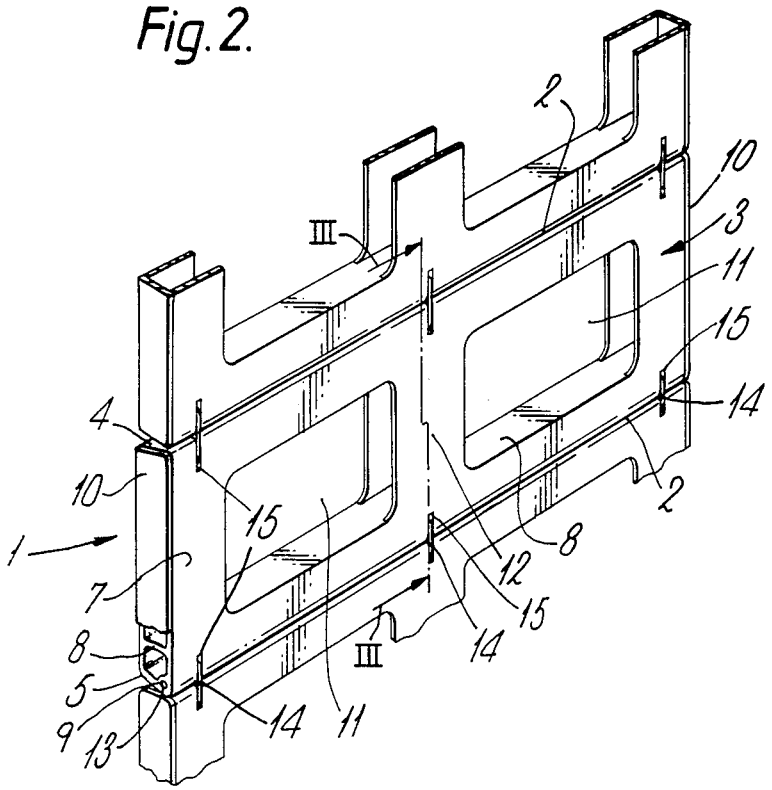
FIG. 2 is a partly cut away rear perspective view of a part of the ladder shown in FIG. 1.
Figure 3:
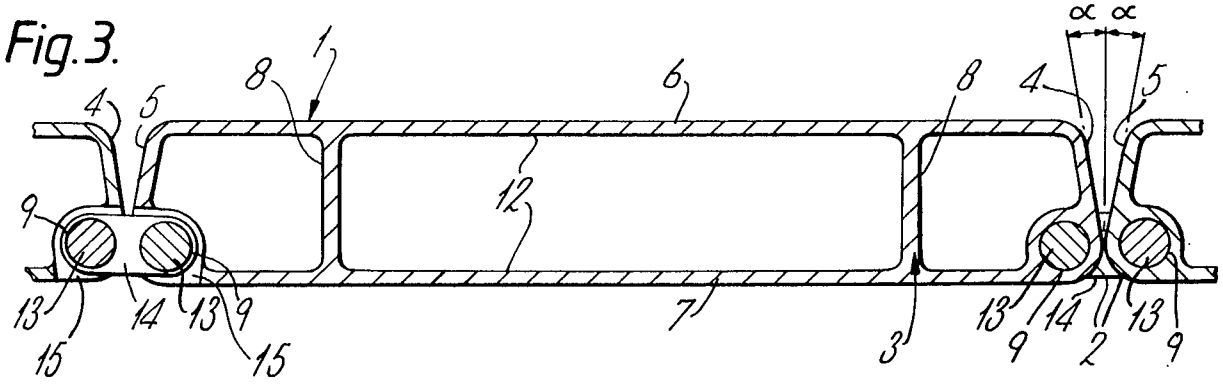
FIG. 3 is a vertical cross section taken on the line III—III in FIG. 2 illustrating the construction of a section of the ladder.

In the example shown in FIGS. 1 to 3 the ladder comprises a string of identical rectangular sections 1 which are hinged together along their longer rear edges 2, each section forming a rung of the ladder. Each section 1 comprises an extruded aluminium or plastics body 3 having a hollow cross section and a trapezoidal external profile when viewed from the end, i.e. in the extrusion direction and parallel to the longitudinal edges 2, providing the section with top and bottom edge faces 4 and 5 respectively which slope towards the front face 6 from the parallel larger rear face 7 at an angle $\alpha$ of 10° to the normal to the front and rear faces. The extruded body 3 also has internal strengthening ribs 8 and a longitudinal bore 9 adjacent each of the longitudinal rear edges 2, and the two ends of the body are closed at the sides of the section by a pair of plates 10 plugged into the body. Two rectangular apertures 11 are stamped or cut out of each of the front and rear faces 6 and 7 of the body 3 between the ribs 8, forming rung defining foot and hand holds which are separated by a central portion 12 of the body which is parallel to the side edges of the section and perpendicular to the longitudinal edges 2.

The sections 1 of the ladder are connected together with their longitudinal rear edges 2 adjacent each other and with their smaller front faces 6 all facing in the same direction, adjacent sections being connected by hinge pins 13 preferably of stainless steel, which are inserted in the bores 9 of the two sections adjacent the junction and are interconnected by links 14 so that each section is able to rotate on its hinge pin but not to slide along it. The links 14 may be positioned at the ends of the hinge pins 13, which may project laterally from the sides of the sections for this purpose, or they may be located, as shown, at intervals along the length of the hinge pins 13, slots 15 being cut in the longitudinal edges 2 of the sections to accommodate the links 14 and permit rotation of the sections. The arrangement of the hinges is such that each section 1 is capable of pivoting rearwards through 180° relative to an adjoining section so that their rear faces 7 will lie substantially face to face. In contrast, however, each section 1 is only able to pivot forwards through an angle of 20° relative to an adjoining section, at which point the top edge face 4 of one of the sections abuts the bottom edge face 5 of the other section to prevent further pivoting of the sections relative to each other in the forward direction, as illustrated for example at 16 in FIG. 1.

The upper end of the ladder is provided with a pair of hooks 17 for suspending the ladder, for example from the toe-rail of a boat, the hooks 17 being connected to a hinge pin 18 extending through the bore 9 adjacent the upper edge 2 of the upper section 1. At its lower end the ladder is provided with a pair of eyes 19 for the attachment of a lifting rope or cable, the eyes 19 being fixed to a hinge pin 20 extending through the bore 9 adjacent the lower edge 2 of the lower section 1. When the ladder is suspended from its upper end and the lower end of the ladder is lifted, each section 1 in turn pivots forwards until its upper stop face 4 engages the lower stop face 5 of the next section to prevent further pivoting, and the lower end is therefore forced outwards as it is raised to follow a curve of predetermined radius.

Consequently the ladder forms a cradle 21 (FIG. 1) of substantially constant radius of curvature as the lower end of the ladder is lifted, the sections lying tangentially to the curve and eventually unfolding from the cradle at the lifted end as new sections are drawn in from the other end. If the ladder is intended for use, amongst other things, as a marine rescue device as described earlier, the dimensions of the sections 1 which determine the radius of curvature of the cradle (i.e. the distance between the edges 2 and the slope of the faces 4 and 5) are selected so that the cradle will comfortably support the torso of a clothed person without squeezing.

Figure 4:
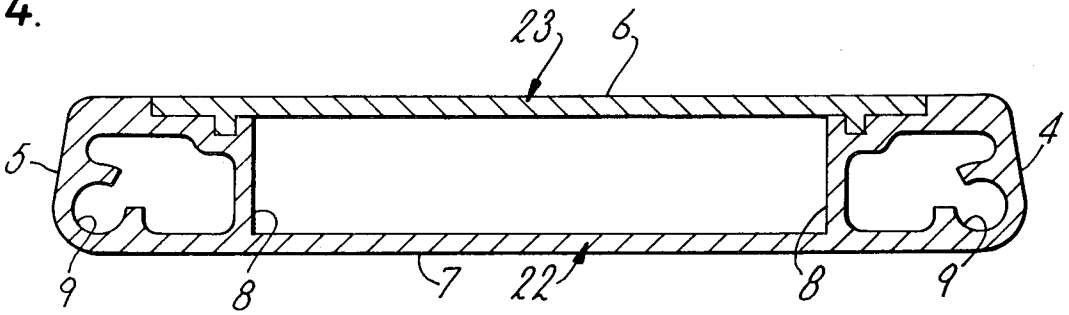
FIG. 4 is a vertical cross section illustrating an alternative construction for each section of the ladder; and, FIG. 5 is a view similar to that of FIG. 2 but illustrating a modified form of the ladder.

FIG. 4 illustrates an alternative construction for the body 3 of each section 1 of the ladder shown in FIGS. 1 to 3. In this case the body 3 is formed by two separately extruded portions 22 and 23 which are subsequently fitted and secured together. One portion 22 includes the top and bottom edge faces 4 and 5, the rear face 7, the reinforcing ribs 8, and the longitudinal hinge pin bores 9 (which in this case are not fully enclosed as shown) of the body 3, and the other portion 23 simply forms the front face 6 of the body. The portions 22 and 23 each has its rung defining apertures 11 stamped out before the portions 22 and 23 are fitted and secured together, this being a much easier process than the formation of the apertures 11 in the unitary body construction of FIG. 3.

Figure 5:
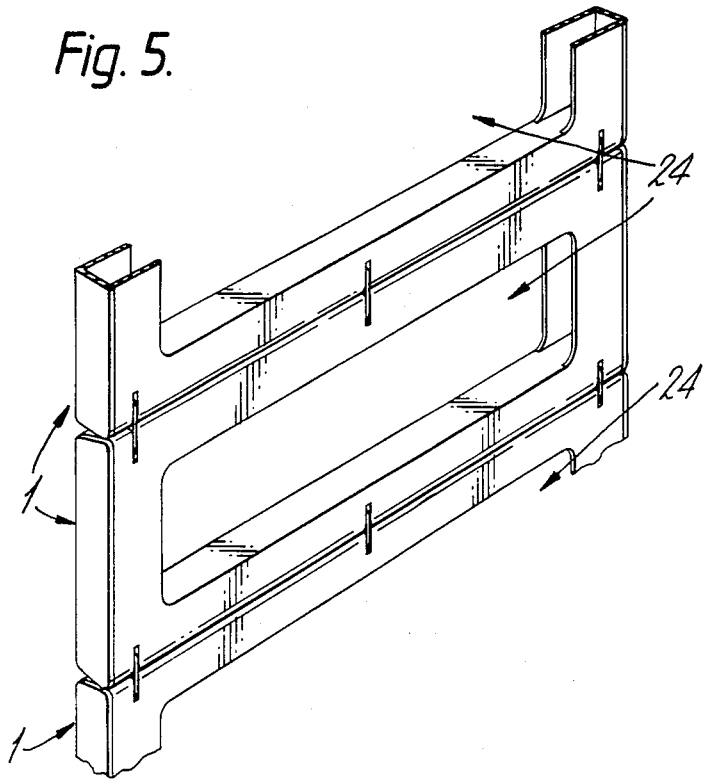

In the modified form of ladder illustrated in FIG. 5, each section 1 of the ladder is provided with a single elongated rectangular rung defining aperture 24 instead of the two separate apertures 11 of the example shown in FIGS. 1 to 3. In all other respects, however, the ladders are identical.

In addition to its use as a marine rescue device, the ladder has many other uses on a boat. For example, it makes an excellent boarding ladder, it can be used as a replacement for the bosun's chair, and it can also be used in a variety of boat cleaning and repair jobs. The ladder can also be useful on land, and is particularly suitable for use as a home fire escape ladder and for some house maintenance jobs, especially external roof inspections and repairs.

I claim:

1. A suspension ladder comprising a string of substantially rigid sections which form the rungs of the ladder and which are hinged together about a series of parallel axes so that the ladder is flexible on both sides of the ladder when the ladder is suspended substantially vertically from its upper end, and stops for limiting the extent to which adjoining sections can pivot towards each other on one side of the ladder so that the ladder can be folded on said one side about said axes to, but not beyond, a predetermined mimimum radius of curvature at which several of the sections together define a cradle adapted to embrace and support confortably the torso of a human body.

2. A ladder according to claim 1, in which the predetermined minimum radius of curvature is between 0.25 and 0.40 meters.

3. A ladder according to claim 1, in which the stops comprise surfaces on each pair of adjoining sections which are arranged to engage each other when the sections are pivoted towards each other on the one side of the ladder and reach a predetermined included angle.

4. A ladder according to claim 1, in which the included angle between adjoining sections at which the stops prevent further pivoting of the sections towards each other on the one side of the ladder is between 150° and 170°.

5. A ladder according to claim 1, in which the sections are hinged together so that adjoining sections are capable of pivoting to a position in which they lie substantially flat against each other on the opposite side of the ladder from that on which the stops are operative.

6. A ladder according to claim 5, in which adjoining sections are hinged together by a hinge comprising a pair of interconnected parallel hinge pins, one of which is received rotatably in a socket in one of the sections, and the other of which is received rotatably in a socket in the other section.

7. A ladder according to claim 1, in which the sections are substantially identical to each other.

8. A ladder according to claim 7, in which each section is rectangular and has at least one aperture defining a rung of the ladder.

9. A ladder according to claim 8, in which each section has two apertures separated by a central portion which is parallel to the side edges of the section and perpendicular to the hinge axes.

10. A ladder according to claim 8, in which each section has a trapezoidal cross sectional profile in the plane perpendicular to the hinge axes whereby the sloping faces of the section form the stops.

11. A suspension ladder comprising a string of substantially rigid sections which form the rungs of the ladder and which are hinged together about a series of parallel axes so that the ladder is flexible in the plane perpendicular to the axes, and stops for limiting the extent to which adjoining sections can pivot towards each other on one side of the ladder so that the ladder cannot be flexed on said one side beyond a predetermined minimum radius of curvature, each of said sections being substantially identical to each other, being rectangular, and having two apertures separated by a central portion which is parallel to the side edges of the section and perpendicular to the hinge axes, each of said sections having a trapezoidal cross sectional profile in the plane perpendicular to the hinge axes whereby the sloping faces of the section form the stops, and each of said sections comprising an extruded length of aluminum or plastics having a longitudinal bore adjacent each longitudinal extending rear edge, adjoining sections being connected by hinge pins which are inserted into the bores adjacent the junction between the sections and which are interconnected by links so that each section is able to rotate on its hinge pin but not to slide along it.

* * * * *